US010260228B2

(12) United States Patent
King et al.

(10) Patent No.: US 10,260,228 B2
(45) Date of Patent: Apr. 16, 2019

(54) PALLETIZED SHELTER SYSTEM

(71) Applicant: Pallet, LLC, Bellevue, WA (US)

(72) Inventors: Braden Roy King, Seattle, WA (US); Amy Michelle King, Seattle, WA (US); Zane Harry Geel, Seattle, WA (US); Troy Kristin Oakes, Aberdeen, WA (US)

(73) Assignee: PALLET, LLC, Bellevue, WA (US)

( * ) Notice: Subject to any disclaimer, the term of this patent is extended or adjusted under 35 U.S.C. 154(b) by 0 days.

(21) Appl. No.: 15/837,814

(22) Filed: Dec. 11, 2017

(65) Prior Publication Data

US 2018/0163391 A1 Jun. 14, 2018

Related U.S. Application Data

(60) Provisional application No. 62/433,032, filed on Dec. 12, 2016.

(51) Int. Cl.
*E04H 1/02* (2006.01)
*E04B 1/343* (2006.01)

(52) U.S. Cl.
CPC ..... *E04B 1/34321* (2013.01); *E04H 1/02* (2013.01); *E04B 1/34384* (2013.01); *E04B 2001/34389* (2013.01); *E04B 2103/04* (2013.01); *E04B 2103/06* (2013.01)

(58) Field of Classification Search
CPC ..... E04B 1/34321; E04B 1/34384; E04B 2103/06; E04B 2103/04
See application file for complete search history.

(56) References Cited

U.S. PATENT DOCUMENTS 2,712,677 A * 7/1955 Hyde ..... A01K 1/033 119/500
4,742,653 A * 5/1988 Napier ..... E04B 1/3445 52/66
5,611,449 A * 3/1997 Pedersen ..... B65D 88/522 220/1.5
6,253,498 B1 * 7/2001 Fanucci ..... E04B 1/3445 52/143
6,968,653 B2 * 11/2005 Stapleton, Jr. ..... E04B 1/3445 52/69
7,431,172 B1 * 10/2008 Spindel ..... B65D 11/1826 217/15
7,510,097 B2 * 3/2009 Spindel ..... B65D 11/1826 217/15
8,613,166 B2 * 12/2013 Smith ..... E04B 1/3445 52/122.1

(Continued)

*Primary Examiner* — Rodney Mintz
(74) *Attorney, Agent, or Firm* — Seed IP Law Group, LLP

(57) ABSTRACT

A palletizable shelter that is easy to deliver, quick and easy to set up with no tools required, easily moveable (light), that can provide sleeping shelter for up to four adults, provide a very modest amount of living space during the day, provide a modest level of storage in a secure (lockable) structure, easily cleaned, can be disassembled with no tools, packaged and stored in a very small volume, and readily deliverable to the next site quickly and easily. A community in a container model is provided that includes multiple palletizable shelters in a collapsed configuration, a common cooking and meeting place, laundry facilities, and a shared bathroom facility that would include toilets, sinks and showers.

17 Claims, 25 Drawing Sheets

(56) References Cited

U.S. PATENT DOCUMENTS

| | | | | |
|---|---|---|---|---|
| 8,707,631 | B2 * | 4/2014 | Scouten | E04B 1/34321 52/220.2 |
| 8,881,470 | B1 * | 11/2014 | Lass | E04H 1/12 52/64 |
| 2005/0044804 | A1 * | 3/2005 | Bin | E04B 1/3445 52/79.5 |
| 2010/0287847 | A1 * | 11/2010 | Smith | E04B 1/3445 52/79.5 |
| 2012/0180404 | A1 * | 7/2012 | Scouten | E04B 1/34321 52/79.5 |
| 2018/0079589 | A1 * | 3/2018 | Meister | B65D 85/62 |

* cited by examiner

20 FOOT HIGH CUBE
EXTERIOR VIEW
AFTER MODIFICATIONS TO
ADD ACCESS DOORS

20 FOOT HIGH CUBE
INTERIOR VIEW
W/PERMANENT FLOOR
& WALL INSTALLED
5-3/4"
PLUMBING
WALL
148
154
152
144
150
140
146
7'-8"
5'-1/4"
2'-2"

1/4" PLASCORE ATTACHED
PERMANENTLY
5-3/4" PLUMBING
FLOOR
142
148
144
140
154
146
8'-10"
8'-4-1/4"
14'-4"
5'-0"
19'-4"

5-3/4"
PLUMBING
FLOOR
152
142
7'-8"
144
154
150
140

PALLETIZED SHELTER SYSTEM

BACKGROUND

Technical Field

The present disclosure is related to shelters and, more particularly, to a rigid, collapsible, reusable shelter and system for storing and deploying multiple shelters in a community setting.

Description of the Related Art

Many changes in a person's personal situation can result in the need for transitional housing. On the natural side, displacement from one's home can result from fire, hurricane, flood, landslides, and other natural and human causes. On the "man-made" side this can include loss of income due to medical tragedy, loss of employment, drug or alcohol addiction, release from incarceration with no place to live, mental illness, and the like. Another possible need for transitional housing is increased capacity for existing disaster or homeless shelters, temporary housing for firefighters in the field, migrant farm workers, etc.

While all of the foregoing events and the resulting needs have similarities, there are obvious differences. Given that many of these needs or applications require land, and many of the applications have neighbors that may not necessarily want to have these types of "encampments" in close proximity to their property, and certainly not be permanent encampments, the solution requires a quick and easy to deliver, quick and easy to set up, quick and easy to disassemble, and quick and easy to move system while at the same time providing a shelter that is adequate in size, out of the weather, safe and secure for the occupants and their loved ones and provide some level of privacy. Many if not all of these needs and applications are by no means new and many solutions to the problems have been utilized over the decades if not centuries.

In the simplest sense, the homeless can be found under bridges or in commercial doorways. There are some homeless that have lived in tents on underutilized land or most recently on public lands. There are many agencies that can provide short term shelter beds. More recently a small collection of very wealthy individuals are cooperating to provide "affordable housing," but the cost for most tenants is still considerably out of reach, and the ability to provide a scalable solution is also unattainable due to the high capital investment. All of these options provide some or many of the solutions to the need for transitional housing, but few if any provide a comprehensive list of solutions.

BRIEF SUMMARY

The present disclosure provides small shelter units that are more durable and have a longer life than a tent, are cost effective and therefore scalable to meet the ever-growing problem of homelessness, are easy to deliver, quick and easy to set up with no tools required, easily moveable (light), can provide sleeping shelter for up to four adults, provide a very modest amount of living space during the day, provide a modest level of storage in a secure (lockable) structure, easily cleaned, can be disassembled with no tools, packaged and stored in a very small volume, and readily deliverable to the next site quickly and easily.

The present disclosure also provides a community in a box model that incorporates a community concept in order to provide the other essential elements of recovery from disaster and that is a sense of community through shared living. This shared living would include common and shared governance, a common cooking and meeting place, laundry facilities, and a shared bathroom facility that would include toilets, sinks and showers.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
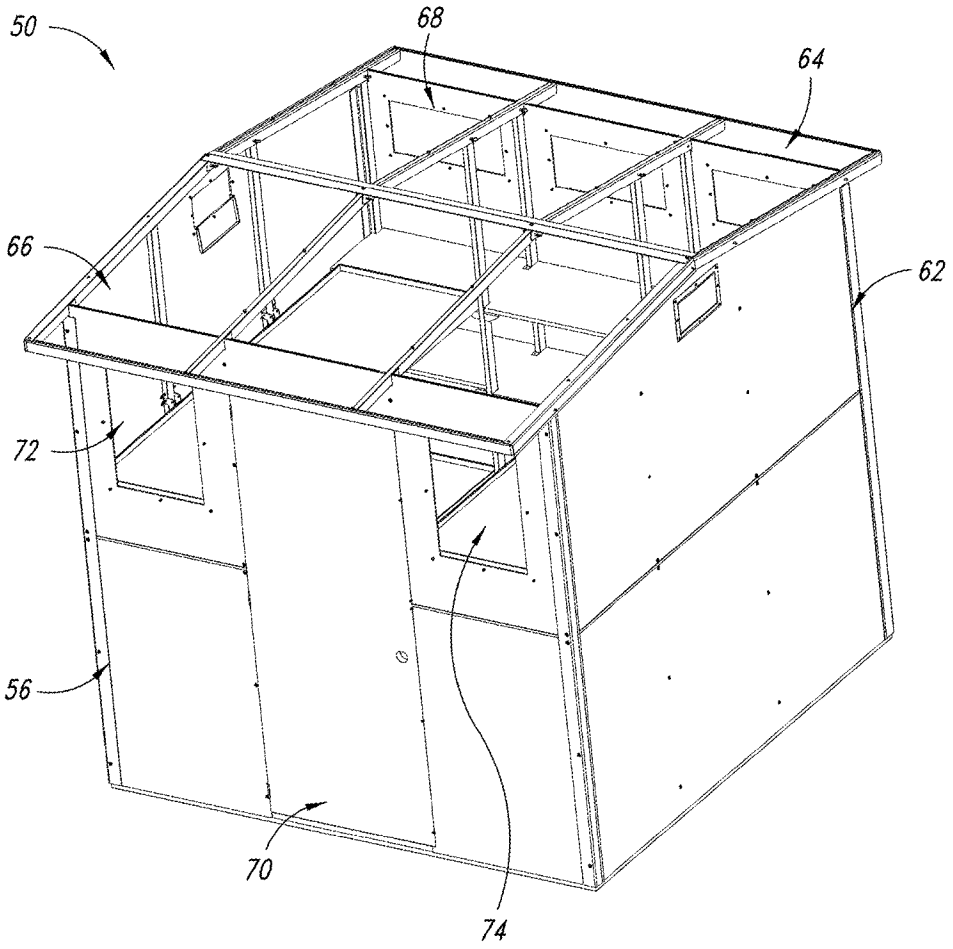
FIG. 1 is an isometric illustration of a shelter formed in accordance with the present disclosure.
Figure 2:
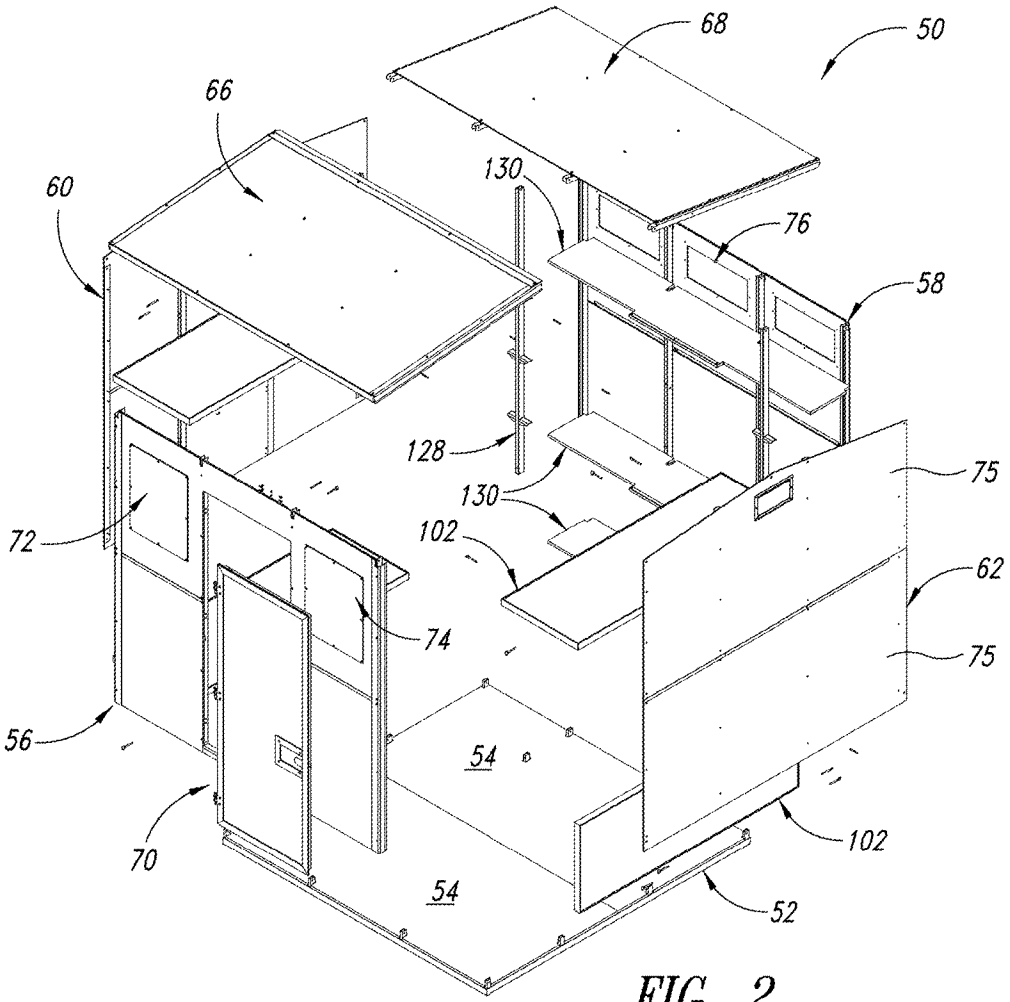
FIG. 2 is an exploded isometric view of the shelter of FIG. 1.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with the use of ISO containers, laundry facilities and equipment, toilets, water and electrical supplies have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

By way of general description, the present disclosure provides shelters that are small, compact dwelling structures, built with light-weight, strong, and relatively inexpensive materials, into a structure that, through the design of the structure itself, further increase the strength of the dwelling unit by nature of the design of the structural elements into a "whole that is stronger than the sum of the pieces."

The basic materials of the dwelling unit include honeycomb polypropylene structural sheets with a thin fiberglass skin on both sides, aluminum rectangular structural elements or frame members, and a thin walled polycarbonate sheet that provides both structure integrity to the roof while providing waterproofing and allowing solar energy in to the interior of the shelter for solar heating.

Further strength is achieved through the design of the aluminum structure or frame in to a protective "cage" with the polypropylene skin providing a barrier to the weather but not required for structural strength. Further strength is achieved through the careful placement of connections between floor-to-wall, wall-to-wall and wall-to-roof subassemblies. Speed of assembly and disassembly is achieved through the use of quick connect pins at each of the above connection points so that the assembly and disassembly is quick, straight forward, and without requiring any tools. Because of this unique design, the wear and tear on the components during the assembly and disassembly process is minimized.

The design of the subassemblies, such as wall panels and roof panels is such that when disassembled they interlock or mesh with each other in a nesting relationship to reduce the virtual thickness of the combined packaged unit and increase the structural integrity of the packaged panels during shipping. The size of the final packaged pallet shelter units is such that they can fit into a 20 foot "high cube" shipping container, and only standing on edge, with maximum utilization of the interior volume of the container. By utilizing a standard shipping container, the full container can also be shipped to anywhere in the world utilizing the benefits of the standardized container for truck, rail, ship or air transport.

Finally, the shelter is one of the basic building blocks of the community model in which the basic building blocks of the community are selected and sized so as to fit within the same shipping container all of the necessary elements to support a full community. This very compact design enables the basic building blocks to be delivered to the site in one "package" that is easily unloaded and easily assembled. When the community needs to be moved, it can be quickly cleaned, broken down, repackaged, stored, and then shipped to the new location.

In accordance with one aspect of the present disclosure there is provided a custom made corner flashing that has two sides of different widths. It is installed on the front wall and back wall corners during fabrication of the front and back wall subassemblies in order to create the gap that the side walls slide in to at the point of final field install assembly. More particularly, the corner flashing is installed at each corner formed by the intersection of two of the four walls. The corner flashing has a first longitudinal leg extending from a second longitudinal leg at substantially a right angle, the first longitudinal leg having a first width, and the second longitudinal leg having a second width that is longer than the first width. The first longitudinal leg is capable of being attached to a first one of the two walls so that the second longitudinal leg is spaced from the first one of the two walls to form a channel between the second longitudinal leg and the first one of the two walls that is sized and shaped to receive the second one of the at least two walls.

Referring initially to FIGS. 1-7, shown therein is a palletizable shelter 50 having a rigid base 52 formed of floor panels 54, four rigid walls attachable to the base 52, the four rigid walls comprising a front wall 56, a rear wall 58, a first side wall 60, and a second side wall 62. The shelter 50 also includes a roof 64 attachable to the four walls, the roof comprising first and second roof panels 66, 68. An access door 70 is provided for the front wall as are first and second front windows 72, 74, ideally formed of plexi-glass, such as Lexan™. Preferably the roof panels 66, 68 are formed of a transparent or translucent polycarbonate sheet to allow additional light to the interior of the shelter 50. The rear wall 58 includes a plurality of upper windows 76 to provide additional light. All four walls have wall panels 75, preferably formed of plascore material.

Figure 3:
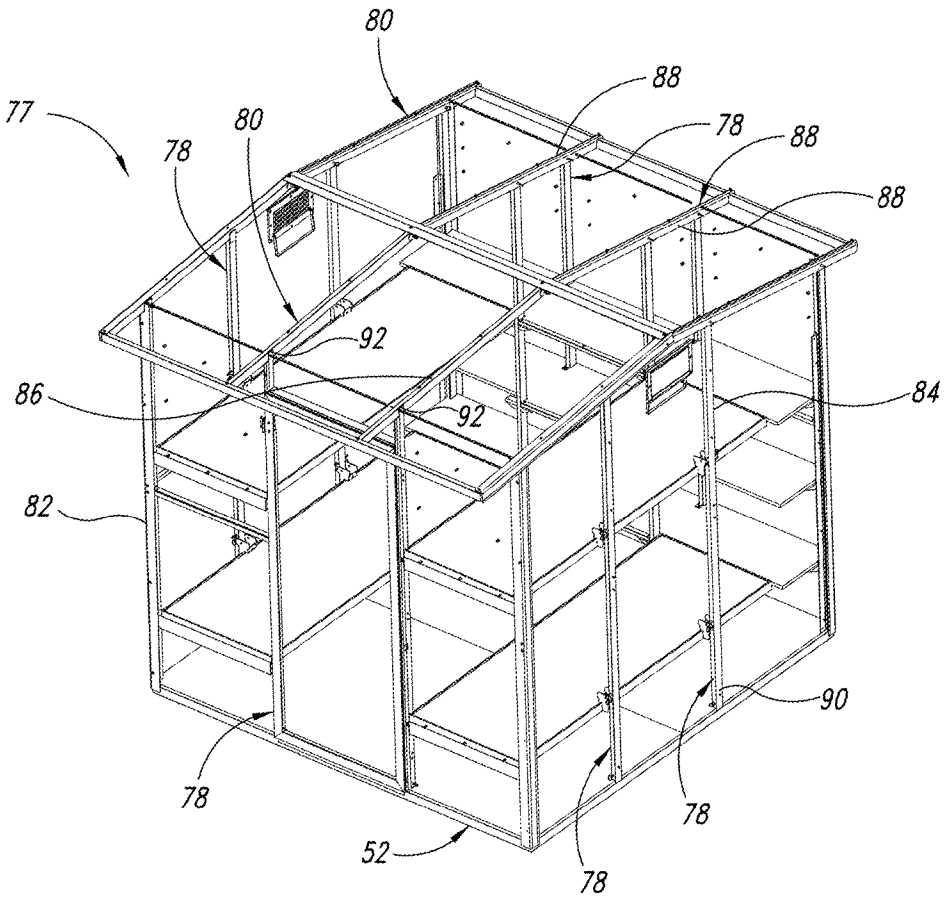
FIG. 3 is an isometric illustration of the rigid framework for the shelter of FIG. 1.
Figure 4:
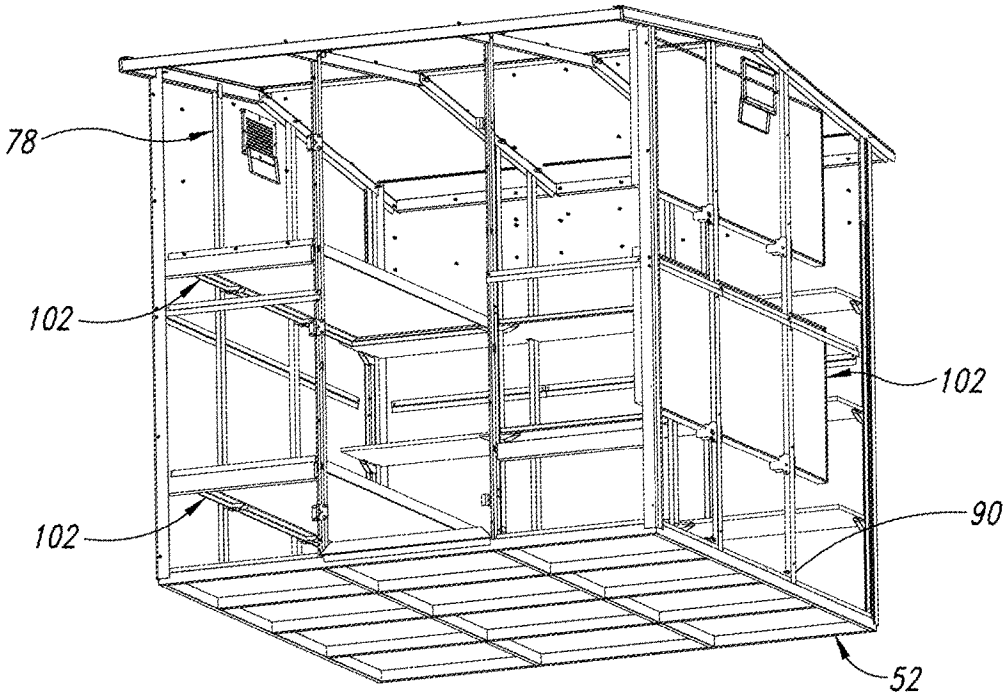
FIG. 4 is a bottom, right front isometric view of the rigid framework of FIG. 2 with the floor panels and four bunks installed.
Figure 5:
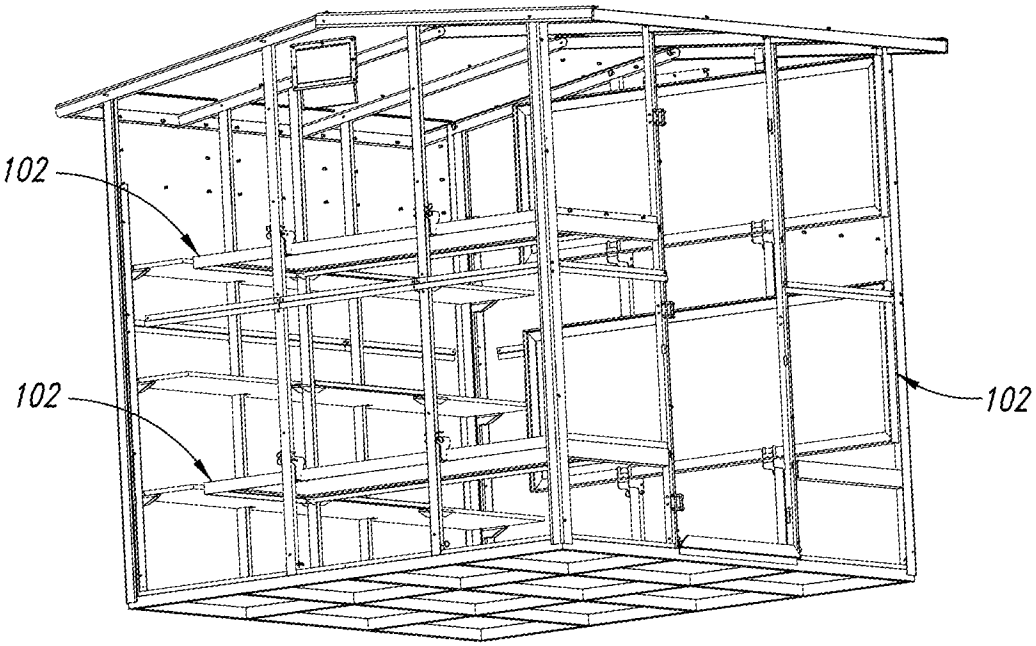
FIG. 5 is a bottom left front isometric view of the rigid framework of FIG. 4.

A rigid framework 77 shown more clearly in FIG. 3 supports the floor panels 54, roof panels 66, 68, and the wall panels 75. The framework 77 includes individual vertical frame members 78 on each of the four walls and joist frame members 80 on the roof. The vertical frame members 82 on the first side wall are sized and shaped to be received within the vertical frame members 84 on the second wall when the first and second side walls 60, 62 are in an abutting face-to-face and rotated in a 180 degree relationship. The joist frame members 86 on the first roof panel 66 are received within the joist frame members 88 on the second roof panel 68 when the first and second roof panels 66, 68 are in an abutting and rotated in a 180 degree face-to-face relationship. Ideally, the vertical frame members 84 on the second wall 62 and the joist frame members 88 on the second roof panel 68 have a U-shaped cross-sectional configuration with a channel that is sized and shaped to receive the vertical frame members 82 of the first wall 60 and the joist frame members 86 of the first roof panel 66, respectively, in the U-shaped channel.

Figure 12:
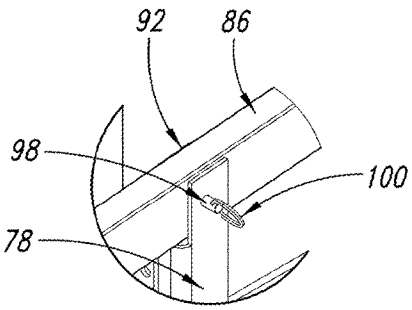
FIG. 12 is an isometric illustration of a second end of a vertical frame member having a saddle that is attached to a joist frame member of a roof panel.
Figure 14:
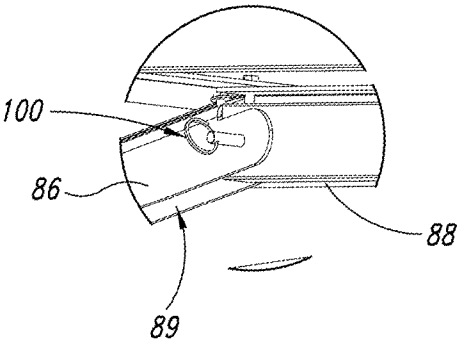
FIG. 14 is an isometric illustration of two roof joist members coupled together with a quick release pin at a roof center ridge in accordance with the present disclosure.
Figure 13:
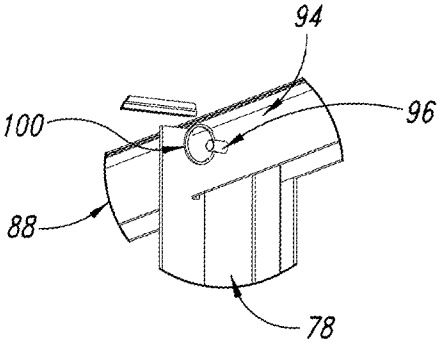
FIG. 13 is an isometric illustration of a second end of a vertical frame member attached to a U-shaped joist frame member.

The vertical frame members 78 on each of the four walls 56, 58, 60, 62 have a first end 90 structured to be coupled to the rigid base 52 and a second end 92 structured to be attached to the joist members 80 on each of the first and second roof panels 66, 68. Preferably the second end 92 of the vertical frame members 78 is structured to be attached to the joist members 86 on the first roof panel 66 with a saddle 92 sized and shaped to receive the joist frame members 86 on the first roof panel 86 as shown in FIG. 12. Conversely, the transverse joist frame members 88 of the second roof panel 68 have a saddle 94 sized and shaped to receive the respective vertical frame members 78 as shown in FIG. 13. Each joist frame member 86, 88 has openings 96 and each vertical frame member 78 has openings 98 that align to receive quick release pins 100 that hold these components together. Ideally the joist frame members 86 have a U-shaped channel 89, as shown in FIG. 14, that is sized and shaped to receive the joist frame member 88 completely within the U-shaped channel 89. This will facilitate storage of the roof panels 66, 68 as described in more detail herein below.

FIG. 14 is a close up illustration of the joist frame members 86, 88 coupled to each other at a center ridge via a quick release pin 100. These quick release pins 100 are readily commercially available and will not be described in detail. They are push to insert and pull to release devices that have a single ball near one end and a pull ring at an opposing end. Other configurations are possible, which are known in the art. The goal is to avoid having to use tools to construct the shelter. Push pins of the quick release type enable rapid assembly and disassembly.

Figure 6:
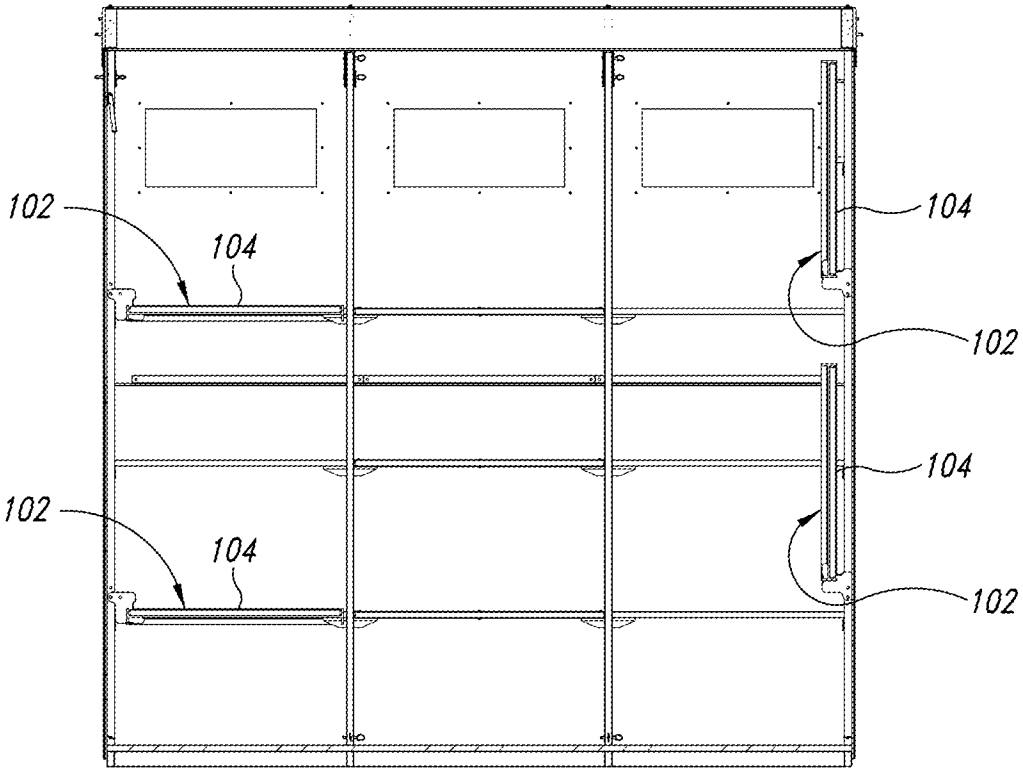
FIG. 6 cut-away front elevational view of the shelter of FIG. 1 showing the interior of the shelter with the four bunk beds.
Figure 9:
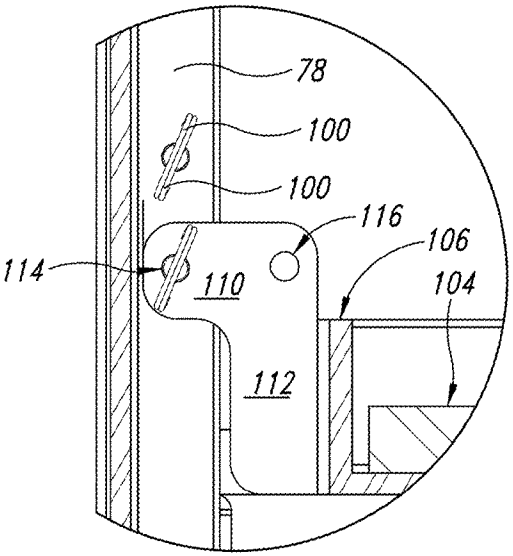
FIG. 9 is a side elevational view of the bunk bracket of FIG. 8 in a down or deployed position.
Figure 8:
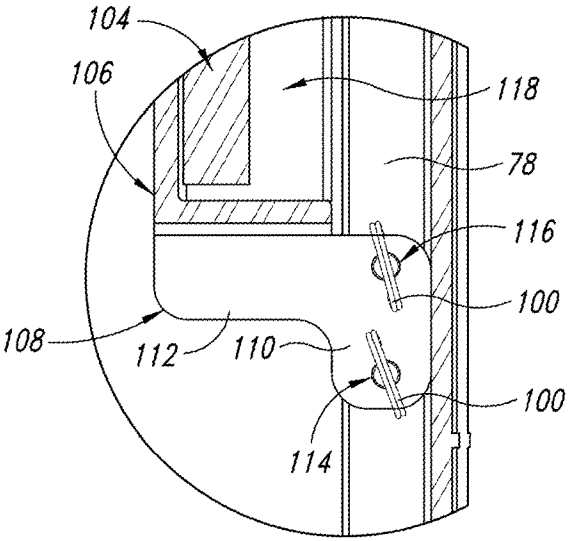
FIG. 8 is a side elevational view of a bunk bracket in an up or stored position in accordance with the present disclosure.

Each shelter 50 can include one or more bunk assemblies 102 that include the planar bunk panel 104 and a frame 106 that is pivotally connected to the vertical frame members 78 as shown in FIGS. 6, and 8-9. FIG. 6 is an elevational view from the front showing two bunk assemblies 102 on the left in an unfolded configuration in which the bunk panel 104 is substantially horizontal and on the right in a folded or stored configuration in which the bunk panel 104 is substantially vertical. An L-shaped bunk bracket 108 pivotally attaches the bunk frame 106 to the vertical frame member 78. The bracket 108 has a short leg 110 integrally formed with a long leg 112 that are oriented at a substantially 90 degree angle, although the angle can vary as needed. At the terminal end of the short leg 110 is a first opening 114 that is used as the pivot point for the bracket 108. A quick release pin 100 acts as the axel for rotation of the bracket 108. The second opening 116 is formed at the intersection of the first and second legs 110, 112 and is used with a quick release pin 100 to retain the bunk assembly 102 in an upright or stored configuration as shown in FIG. 8. When the pin 100 is removed from the second opening 116, the bunk assembly 102 can pivot about the pin 100 in the first opening 114 to the deployed or horizontal configuration shown in FIG. 9. The frame 106 will then swing towards the vertical frame member 78 and bear against it to hold the bunk assembly 102 in the horizontal position. The bracket 108 is sized and shaped to position the bunk panel 104 away from the respective wall by creating a space 118 in which bedding or a mattress can remain in place without impeding raising the bunk assembly 102 to the full upright or stored configuration.

Figure 7:
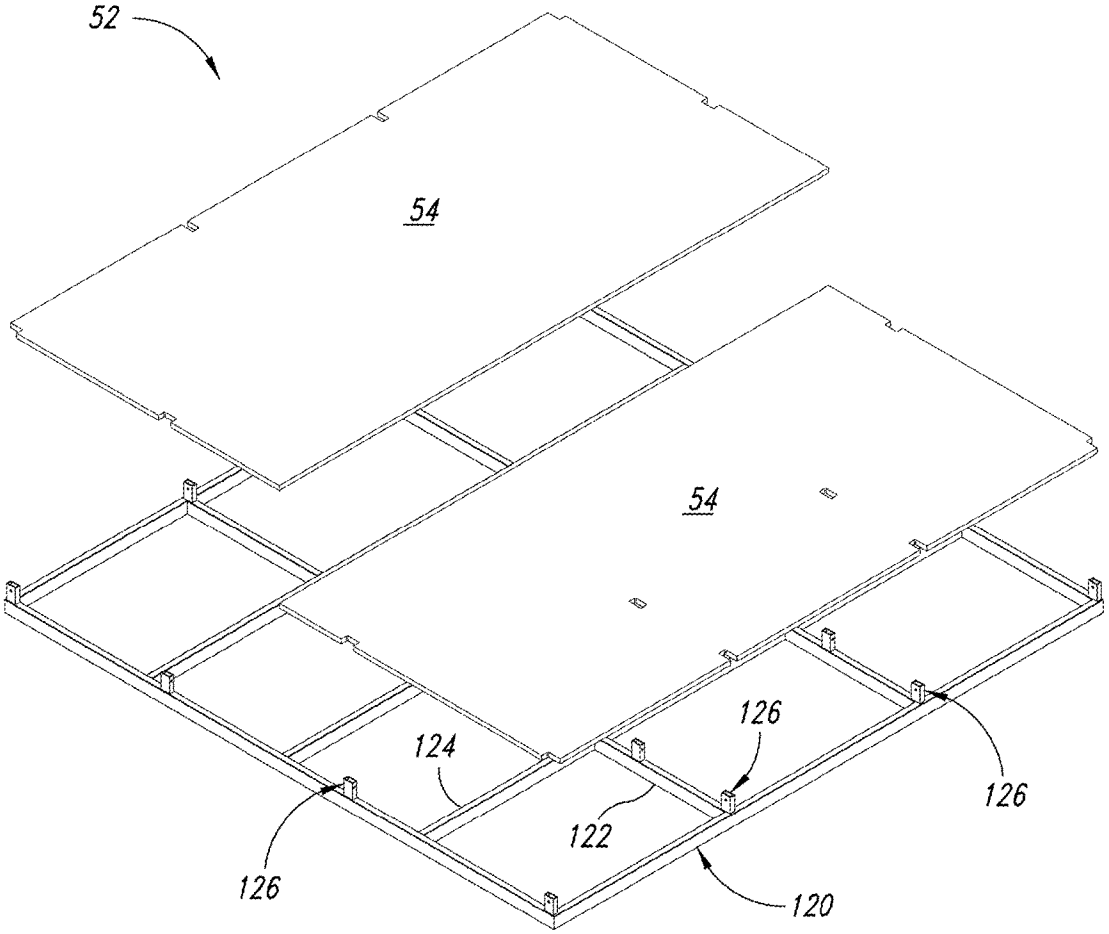
FIG. 7 is an exploded isometric top view of the floor panels positioned above the assembled floor framework formed in accordance with the present disclosure.
Figure 11:
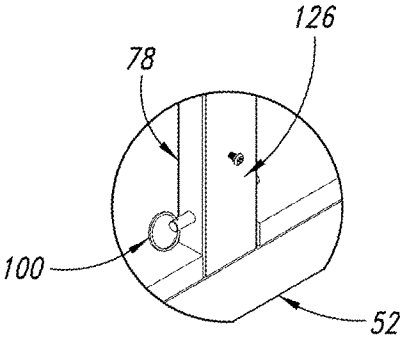
FIG. 11 is an isometric illustration of a first end of a vertical frame member attached to the floor framework in accordance with the present disclosure.

FIG. 7 shows the rigid base 52 in an exploded view with the floor panels 54 positioned above a floor frame 120. The frame in this implementation has a grid of longitudinal 122 and transverse 124 frame members. A plurality of saddles 126 extend upward from the longitudinal and transverse frame members 122, 124 for attachment to the vertical fame members 78. FIG. 11 shows in close up the attachment of the vertical frame member 78 to the saddle 126 with a quick release pin 100.

Figure 10:
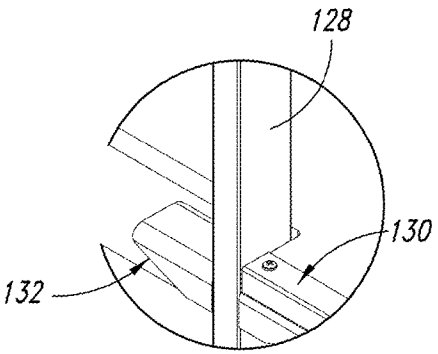
FIG. 10 is an isometric illustration of a bunk support shelf formed in accordance with the present disclosure.

A center support 128 is also shown (see FIG. 2) that is used to support one or more shelves 130 on the back wall 58. FIG. 10 is an enlarged view of a shelf support bracket 132 that extends from the center support 128 and is sized and shaped to support the shelf 130. These brackets 132 are also formed on or attached to respective vertical frame members on the rear wall 58. As such, the shelf 130 rests on the brackets 132 with no need for fasteners, although fasteners may be employed if desired. The center support 128 is attached at its lower end to the saddle 126 on the base panel 52 and at its opposing upper end to a joist frame member 88 with quick release pins 100.

Figure 15:
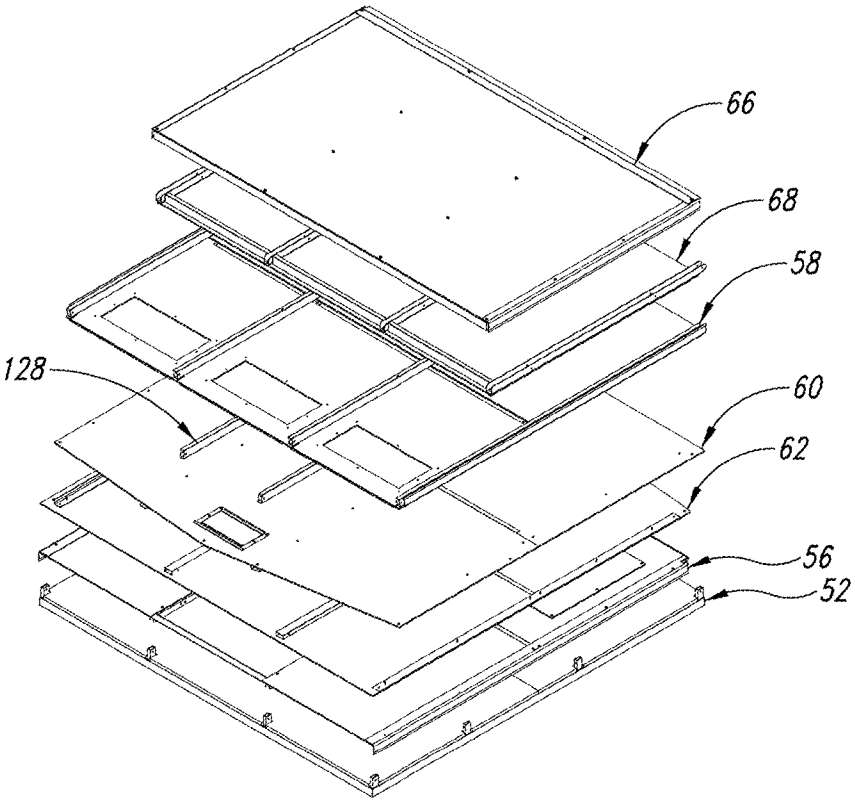
FIG. 15 is an exploded top isometric view of the palletized shelter formed in accordance with the present disclosure.
Figure 16:
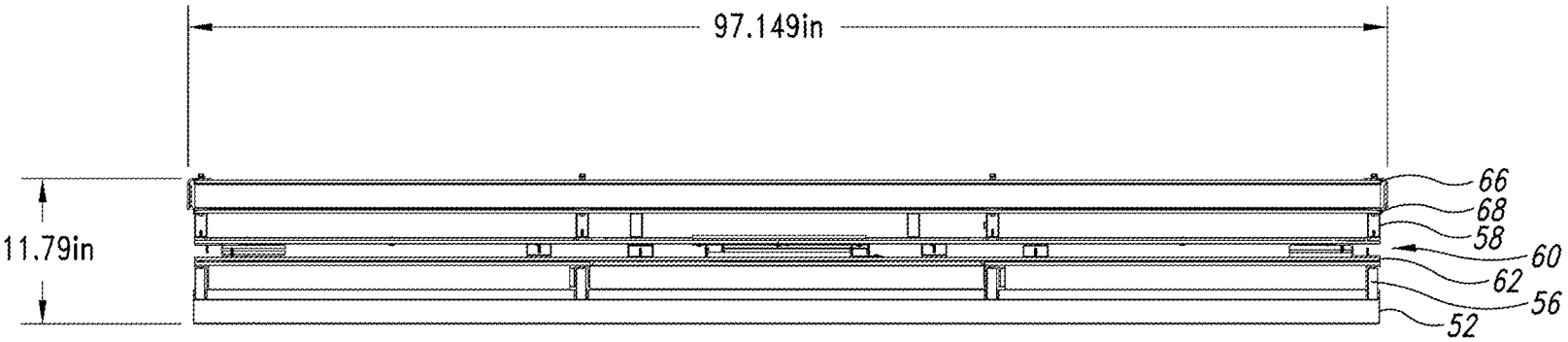
FIG. 16 is a front elevational view of the palletized shelter formed in accordance with the present disclosure.
Figure 17:
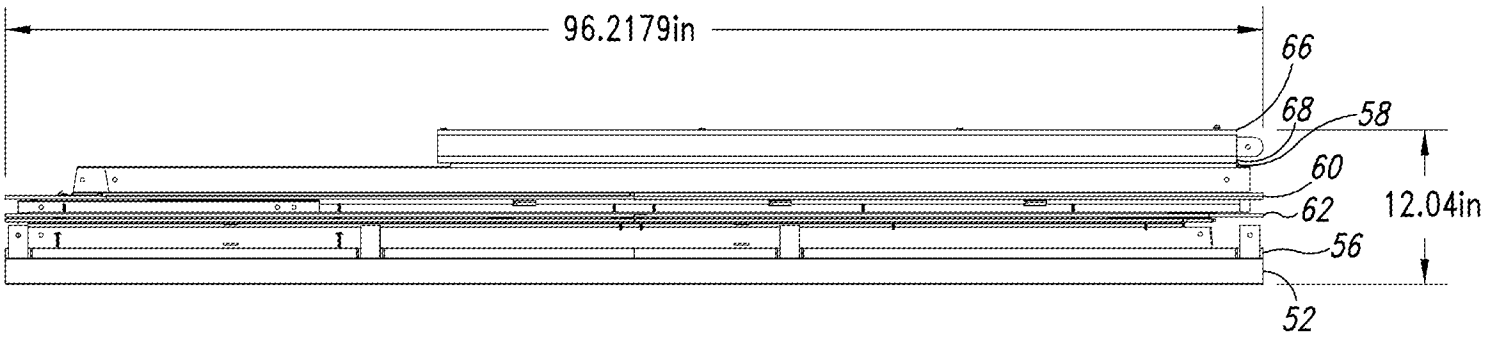
FIG. 17 is a side elevational view of the palletized shelter of FIG. 16.

In use, the shelter 50 has a deployed configuration as shown in FIG. 1 in which the base 52, the four walls 56, 58, 60, 62, and the roof 64 are attached together via the rigid framework 77 to form a shelter that defines an enclosed interior. As shown in FIGS. 15-17, the shelter 50 has a palletized configuration in which the first and second side walls 60, 62, the front wall 56, the rear wall 58, and the first and second roof panels 66, 68 are layered on the rigid pallet and in which the first and second side walls 60, 62 are in the abutting face-to-face and rotated in a 180 degree relationship. In addition, the vertical frame members 82 of the first side wall 60 are received within the vertical frame members 84 of the second side wall 62, and further in which the first and second roof panels 66, 68 are in the abutting face-to-face and rotated in a 180 degree relationship with the joist frame members 86 on the first roof panel 66 receiving the joist frame members 88 on the second roof panel 68.

Figure 18:
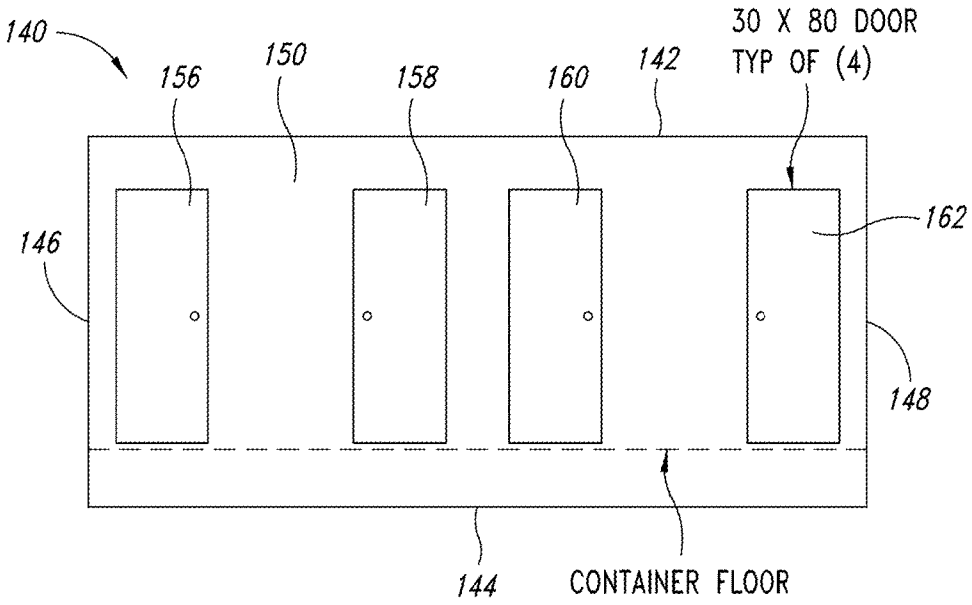
FIG. 18 is a front elevational view of the exterior of a container formed in accordance with the present disclosure.
Figure 19:
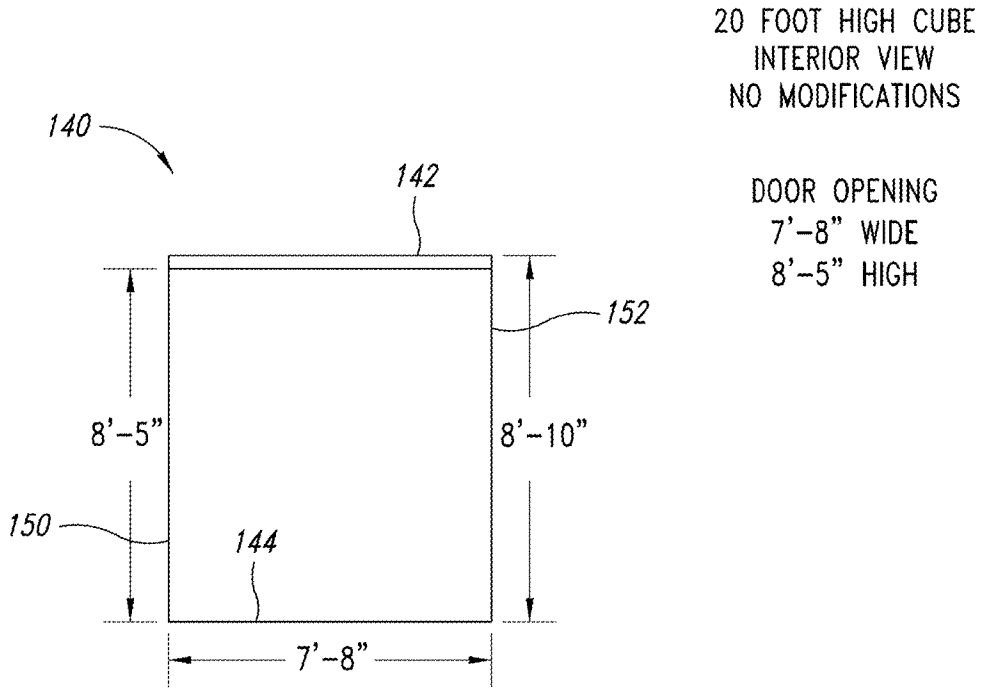
FIG. 19 is a right side elevational view of the container of FIG. 18.
Figures 20A, 20B, 20C:
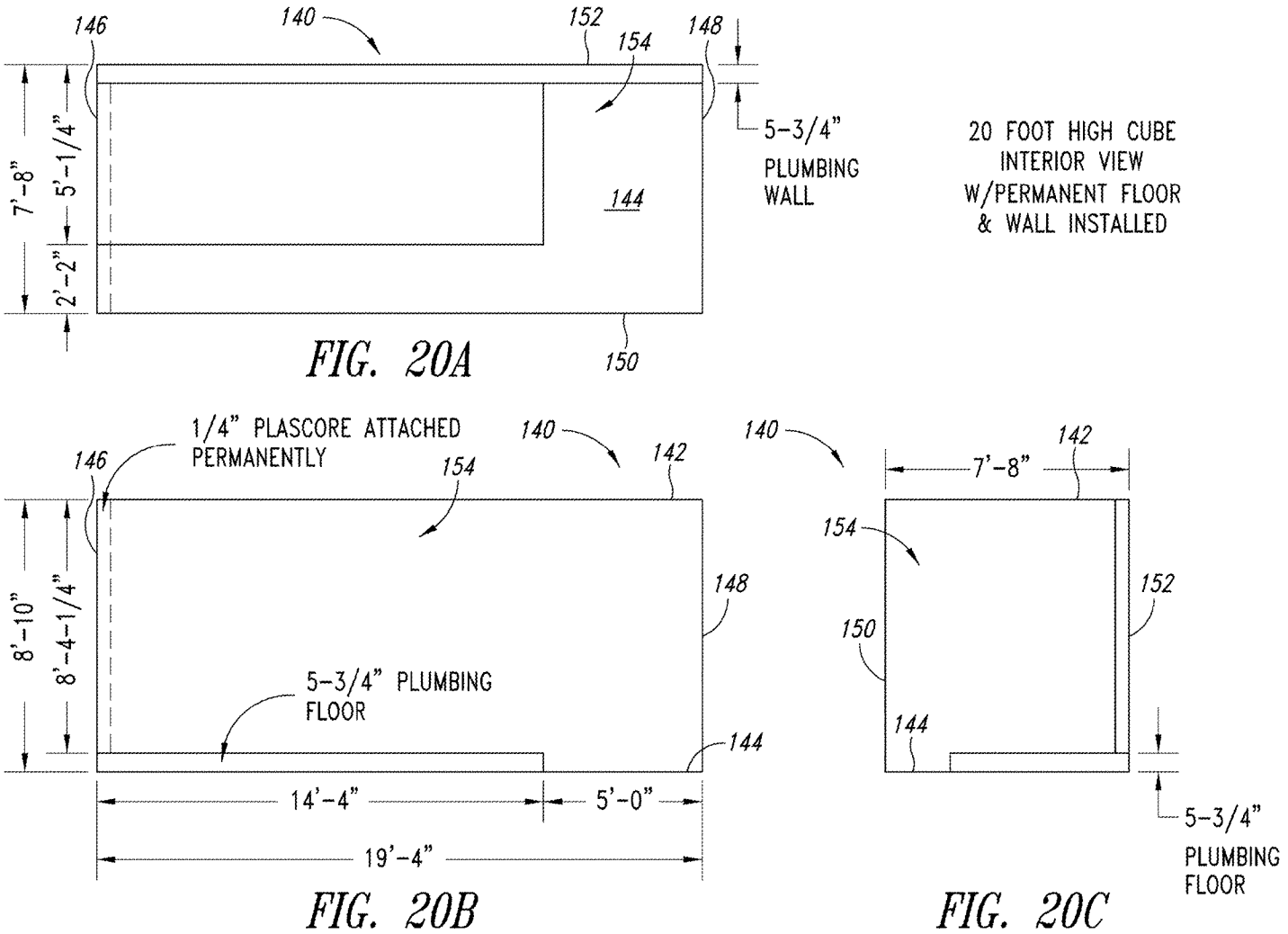
FIGS. 20A-20C are a top plan view, a front elevational view, and right side view, all in cross section, of the container of FIG. 18.

Referring next to FIGS. 18-19, FIG. 18 is a front elevational view of the exterior of a container 140 and FIG. 19 is a right side elevational view thereof formed in accordance with the present disclosure. The container 140 is preferably a 20 foot high cube container that has a substantially rectangular shape defined by a top wall 142, a bottom wall 144, first and second end walls 146, 148, and a front wall 150 and rear wall 152 as shown in FIGS. 19 and 20A-20C, all of which enclose the inside space or interior 154. Typical dimensions for the exterior are about 20 feet wide by 9 feet tall and a depth or length of 8 feet. The size of the doorway on the second end wall 148 is about 7 feet 8 inches wide and 8 feet 5 inches tall. The dimensions of the container 10 and its doorway will limit the size of the palletized shelters 50 and constrict the loading protocol to ensure the maximum usage of the interior volume.

FIG. 18 shows the front wall 150 having four doors, the first three doors 156, 158, 160 provide ingress and egress for three restrooms respectively, and the fourth door 162 provides access to a laundry room. The doors are positioned an appropriate distance above the bottom wall 144 of the container to accommodate an interior floor.

Figure 21:
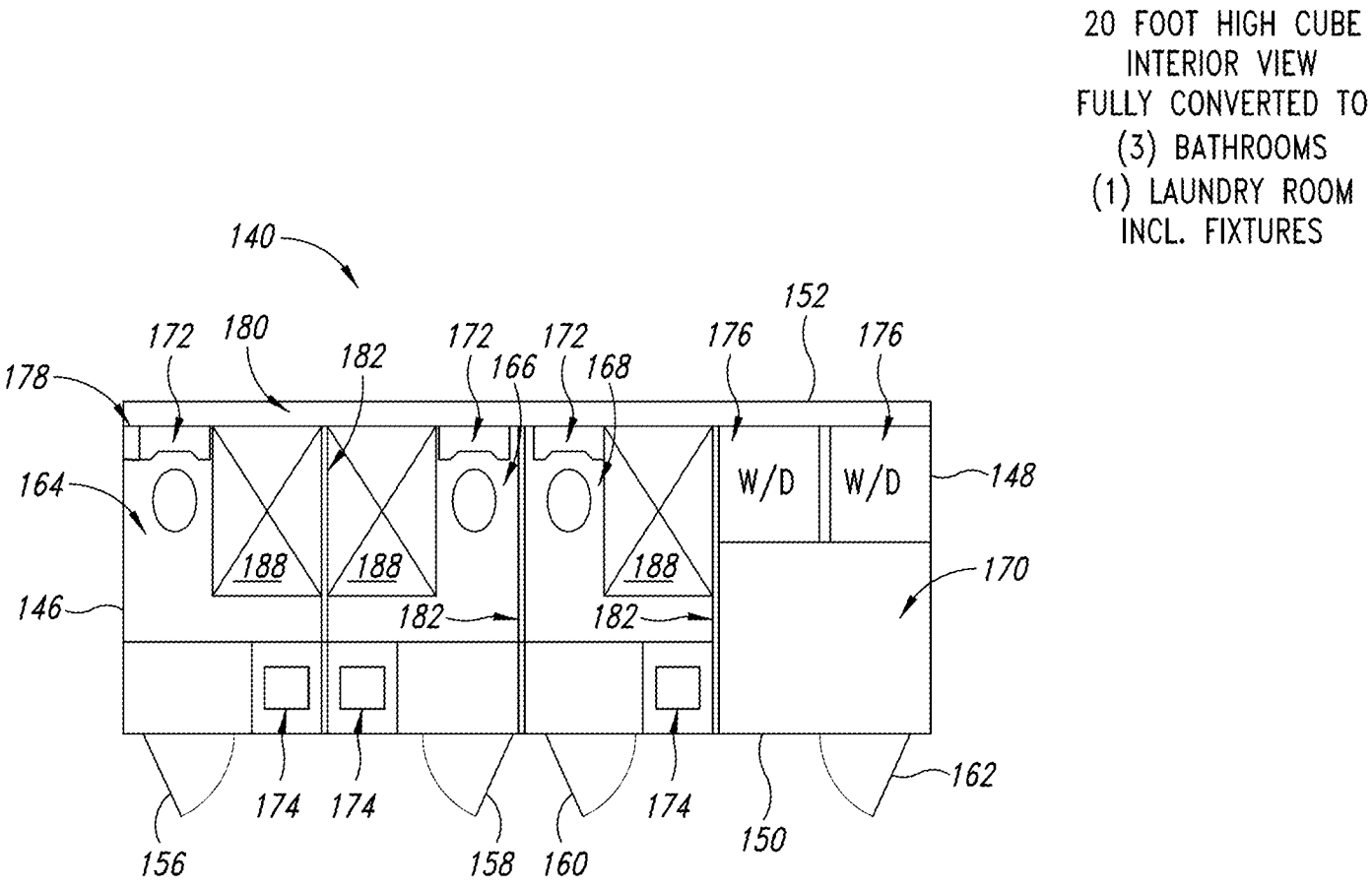
FIG. 21 is a top plan view in cross section showing the interior of the container configured with restrooms and a laundry room.
Figure 22:
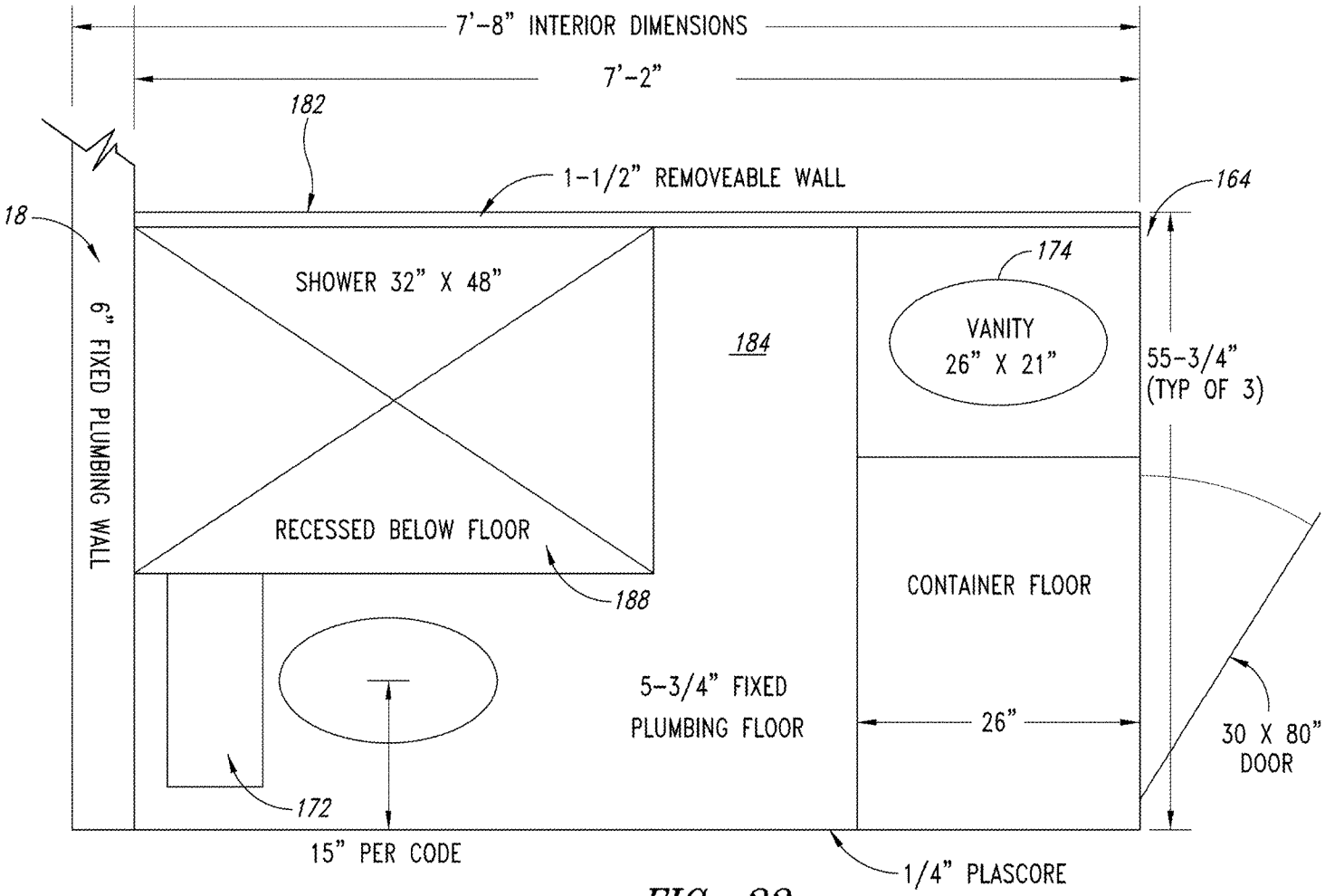
FIG. 22 is an enlarged top plan view of a single restroom in the container of FIG. 21.
Figure 23:
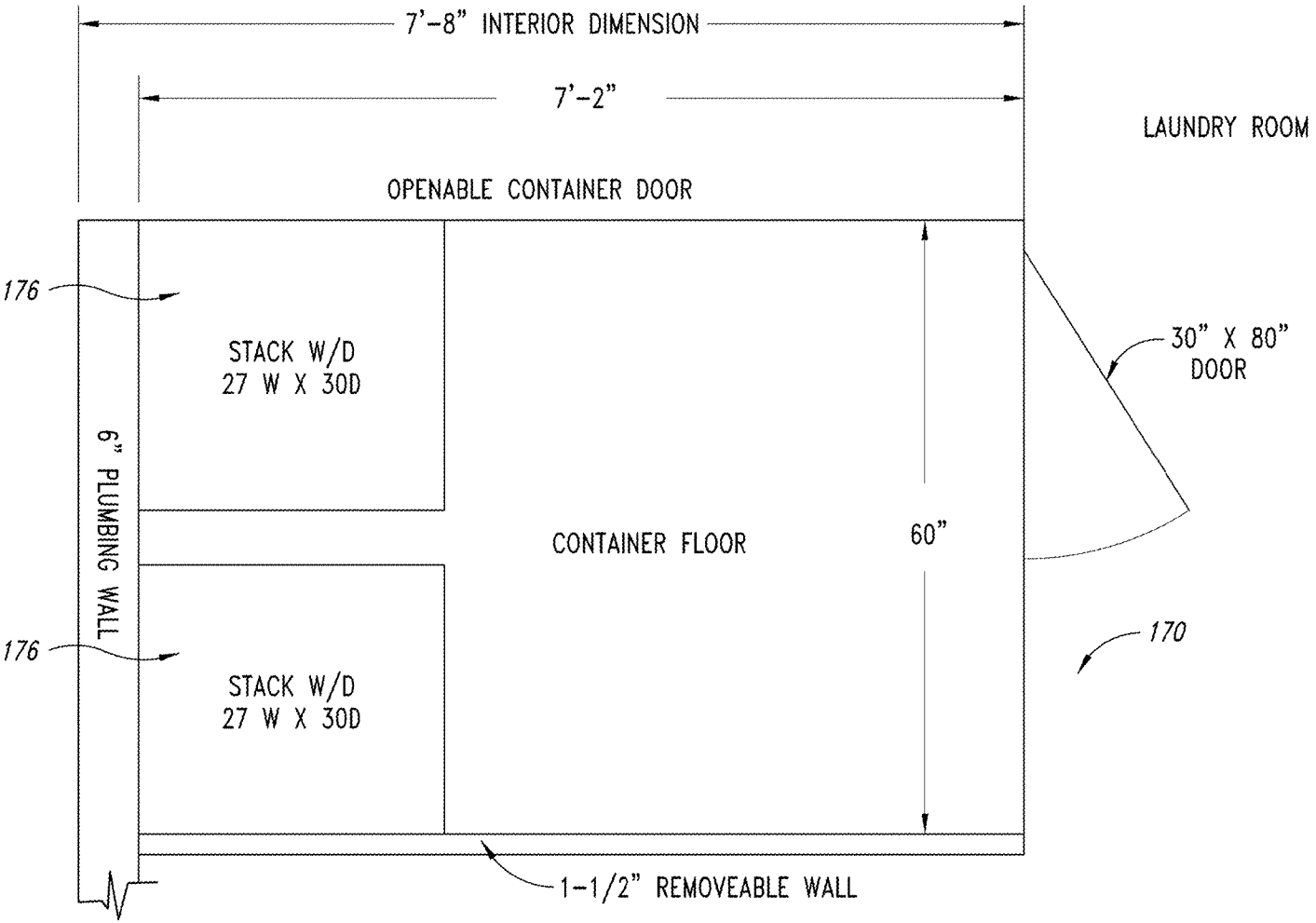
FIG. 23 is an enlarged top plan view of a single laundry room in the container of FIG. 21.

FIG. 21 is a top plan view in cross section showing the interior 154 of the container 140 configured with three restrooms 164, 166, 168 and a laundry room 170. Each of the restrooms preferably includes a toilet 172 and a sink 174 for hand washing. Ideally the restroom also includes a shower 188 as described below. The laundry room 170 preferably includes two stacked washer-dryer units 176. An interior wall 178 provides a space 180 from the exterior rear wall 152 for the routing of plumbing and possibly electrical wires. In one representative implementation the space has a 6 inch dimension. Removable partitions 182, preferably having a thickness of 1.5 inches, extend from an interior floor 184 to an interior ceiling 186 or at least partially extend there between to provide privacy. As shown in FIG. 22, each restroom 164, 166, 168 may also be equipped with an optional shower 188 that may be slightly recessed below the floor 184. FIG. 23 is a close-up illustration of one configuration of the laundry room 170 showing the arrangement of the stacked washer-dryer unit 176.

FIGS. 24 through 28 are pictorial representations in a top plan view illustrate the five layers in the container 140 when it is fully packed. The arrangement of the components illustrated and described herein is but one of a number of ways to efficiently orient the components for storage, transport, and deployment.

Figure 24:
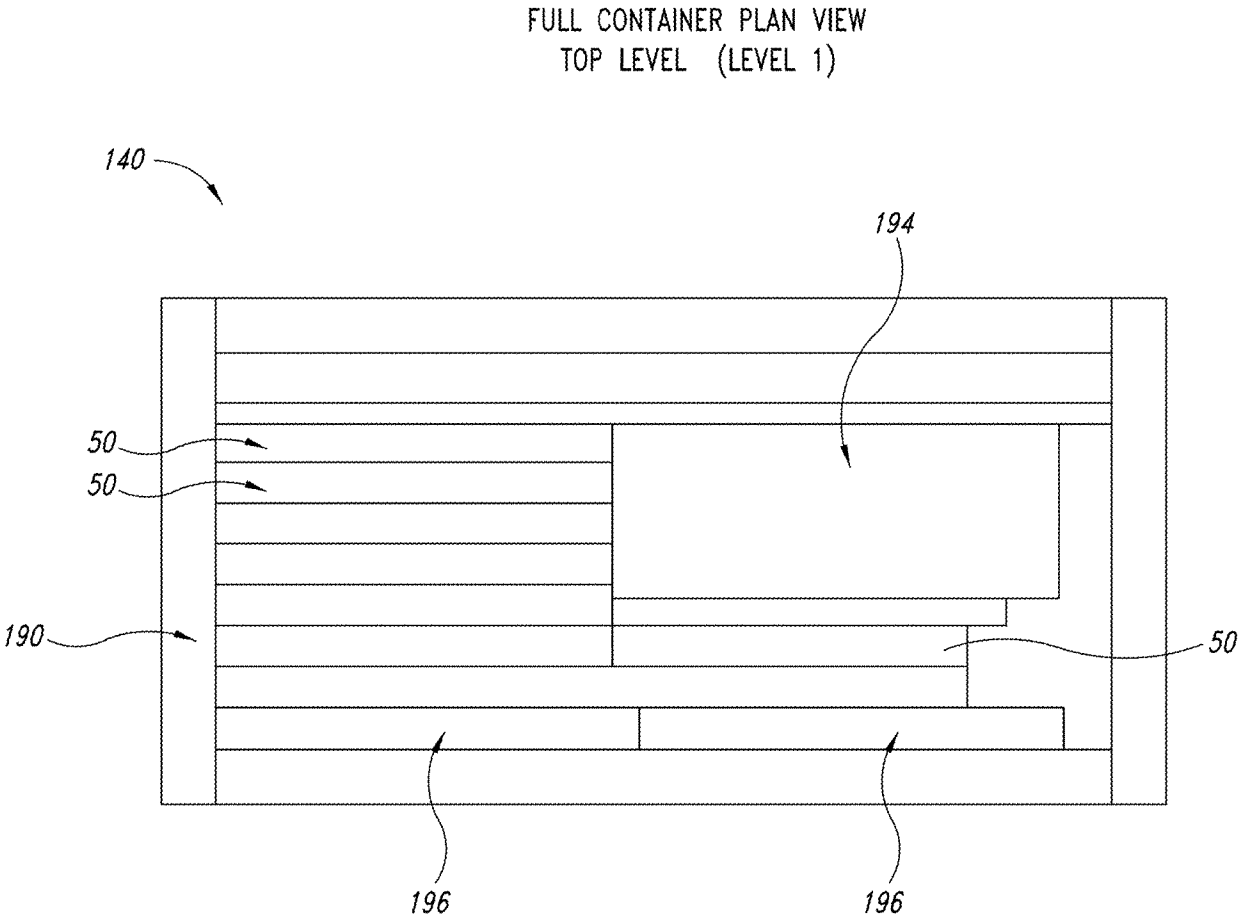
FIG. 24 is a top plan view of the container of FIG. 18 in cross section showing a first layer of the full container.
Figure 25:
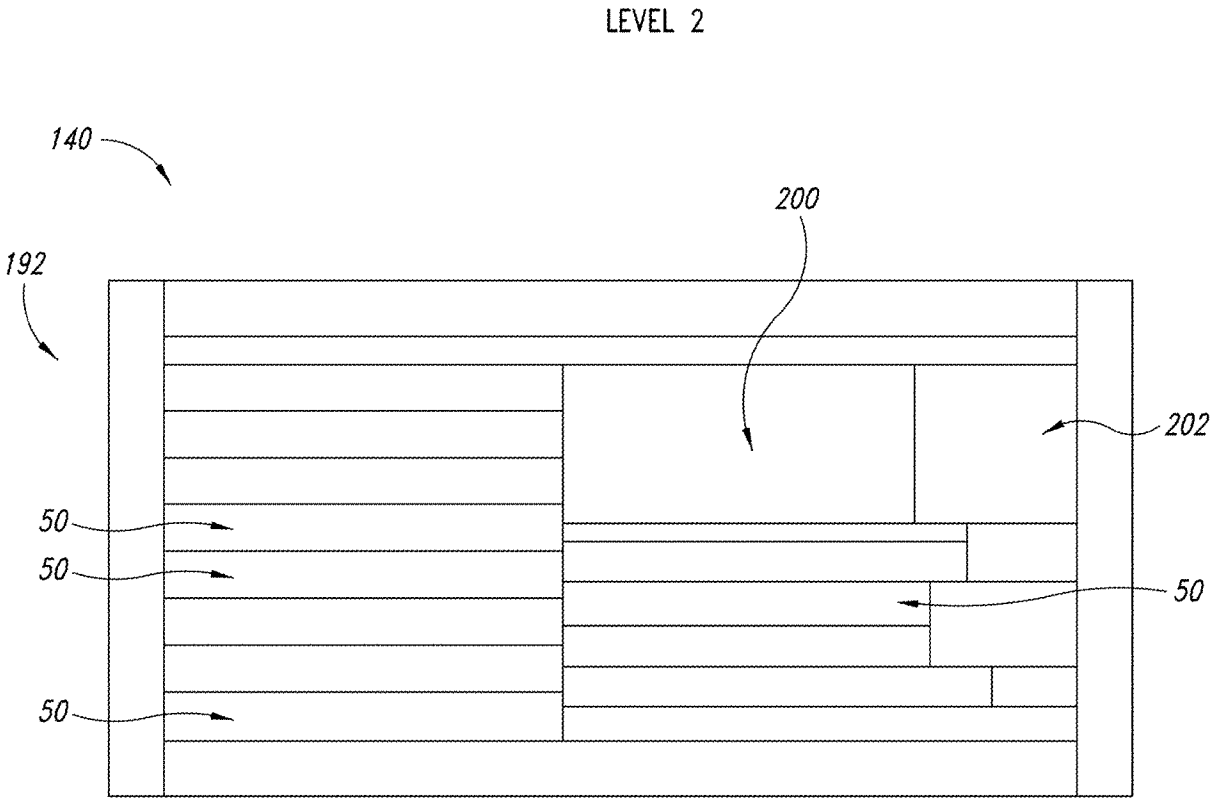
FIG. 25 is a top plan view of the container of FIG. 18 in cross section showing a second layer of the full container.

FIG. 24 is a top plan view of the container 140 of FIG. 18 in cross section with the container top removed to show a first layer 190 of the full container 140. In this layer the components of a community yurt 192 (shown assembled in FIGS. 29 and 30) are shown in disassembled condition to include four pieces of a yurt floor 194, and two yurt roof rafters 196. Also shown are the palletized shelters 50 standing on edge FIG. 25 is a top plan view of the container 140 of FIG. 18 in cross section showing a second layer 198 of the full container 140. With the yurt floor 194 and rafters 196 removed, there can be seen first and second lower cabinets 200, 202

Figure 26:
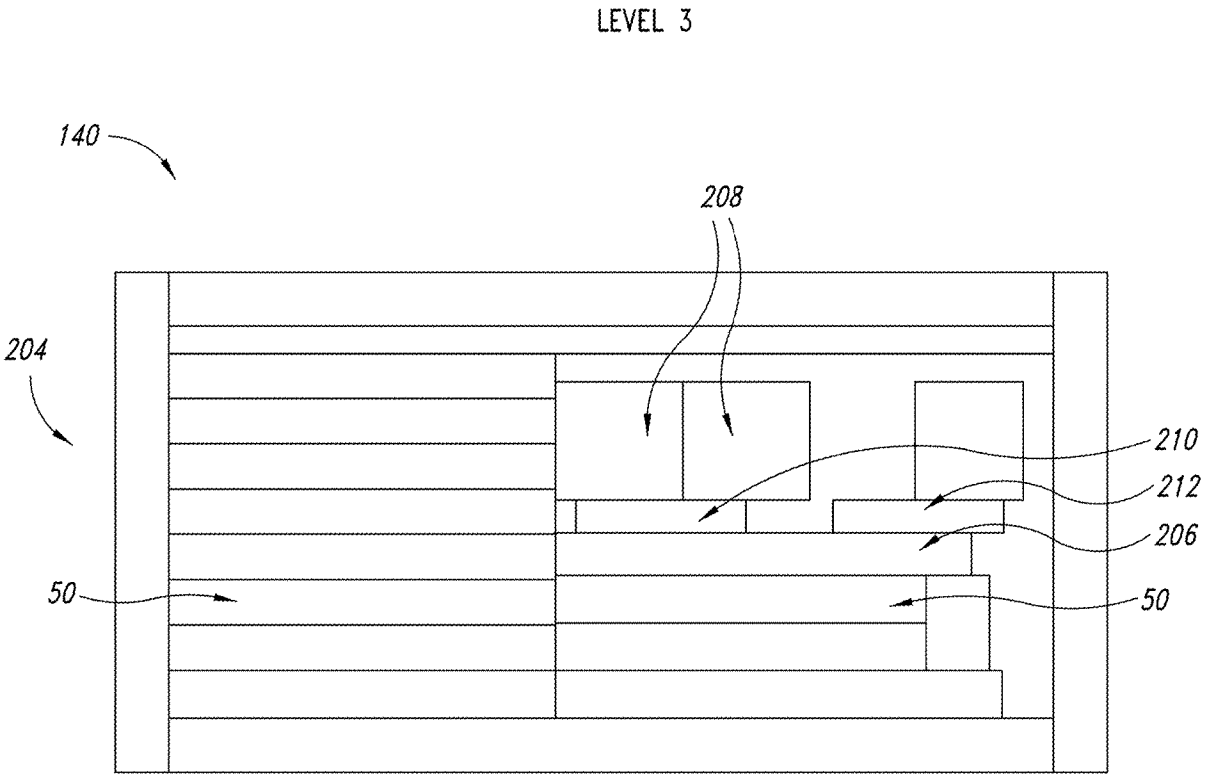
FIG. 26 is a top plan view of the container of FIG. 18 in cross section showing a third layer of the full container.

FIG. 26 is a top plan view of the container 140 of FIG. 18 in cross section showing a third layer 204 of the full container 140. Here, an upper cabinet 206 is shown along with two refrigerators 208, a yurt wall canvas 210 and yurt roof canvas 212.

Figure 27:
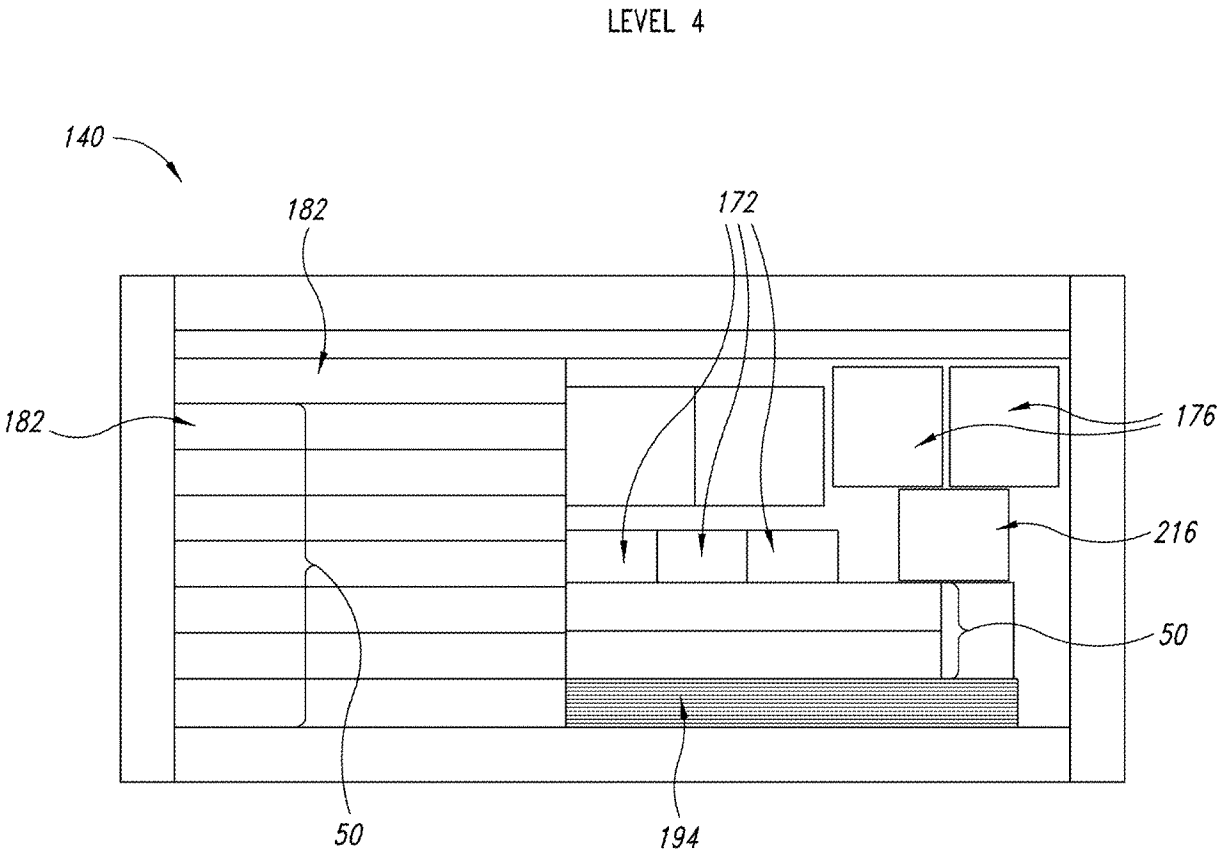
FIG. 27 is a top plan view of the container of FIG. 18 in cross section showing a fourth layer of the full container.

FIG. 27 is a top plan view of the container 140 of FIG. 18 in cross section showing a fourth layer 214 of the full container 140. Here, in addition to the 9 palletized shelters 50 and 12 pieces of the yurt floor 194, there can be seen three toilets 172, two stacked washer-dryer unites 176, a range 216, and the three removable partitions or walls 182.

Figure 28:
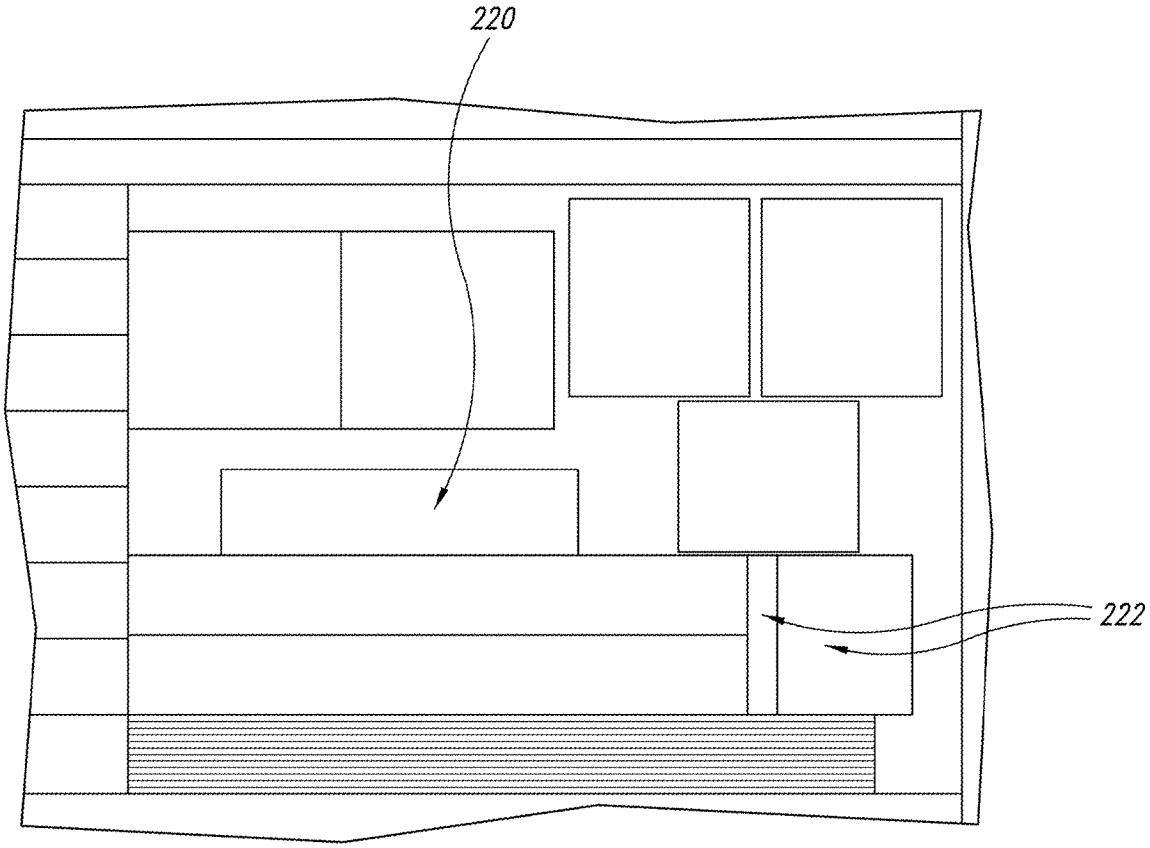
FIG. 28 is a top plan view of the container of FIG. 18 in cross section showing a fifth layer of the full container.

FIG. 28 is an enlarged top plan view of the container 140 of FIG. 18 in cross section showing a fifth layer 218 of the full container 140. Here the three toilets 172 are removed to show a lattice wall 220 of the yurt 192 and three vanities 222 (two shown, with a third vanity below one of the vanities 222).

Figure 29:
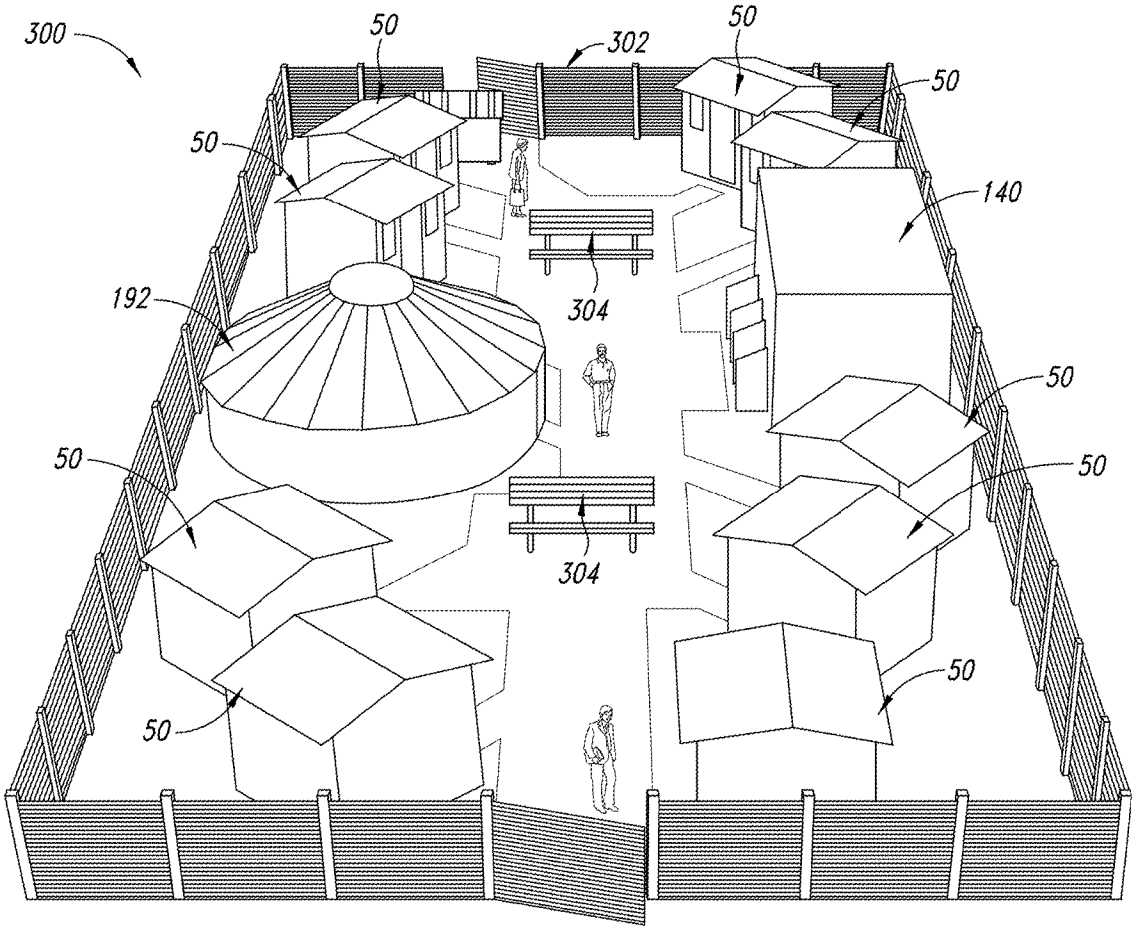
FIG. 29 is a pictorial view of a pallet community unpacked from a single container and deployed for use.
Figure 30:
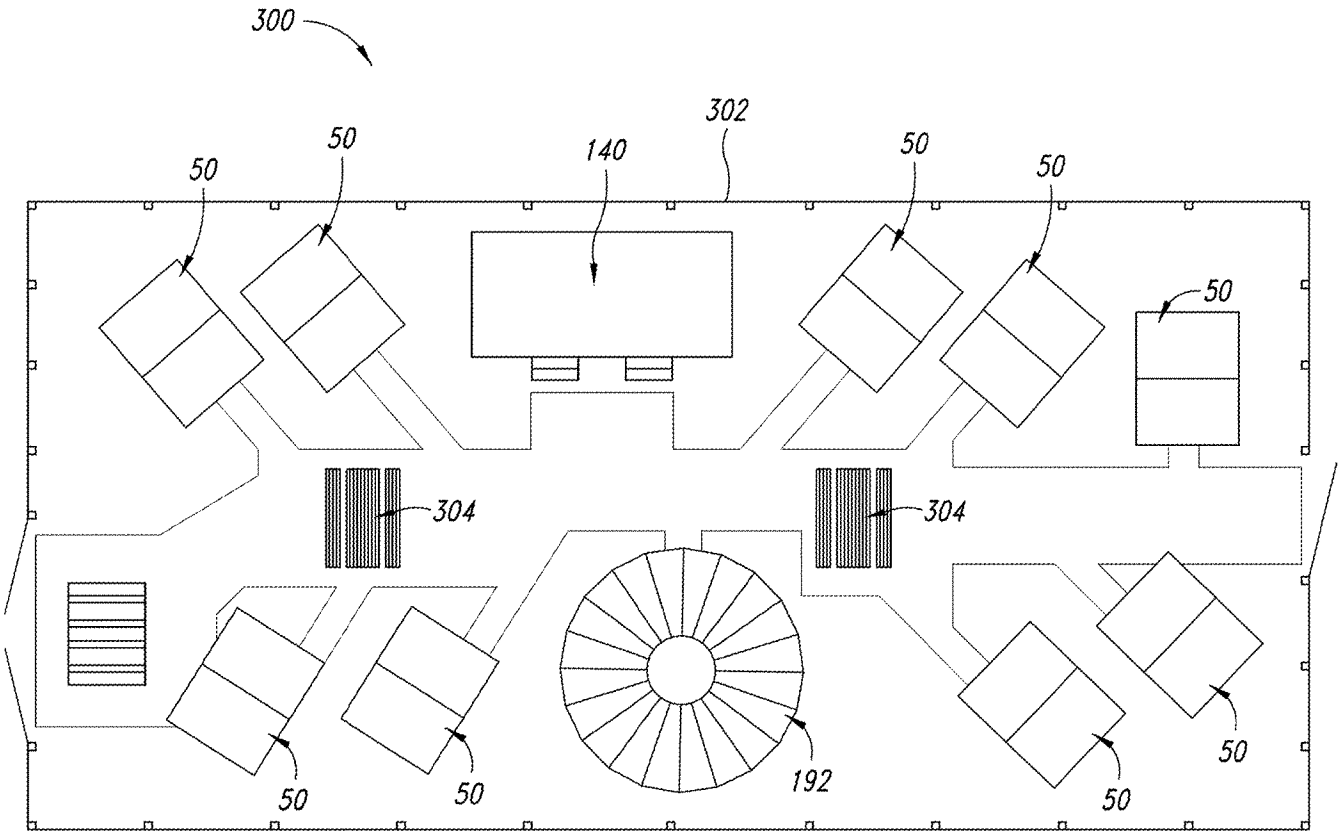
FIG. 30 is a top plan view of the pallet community of FIG. 29.

FIG. 29 is a pictorial view of a pallet community 300 unpacked from a single container 140 and deployed for use, and FIG. 30 is a top plan view of the pallet community 300 of FIG. 29. In this particular implementation of the present disclosure, there are nine palletizable shelters 50, the yurt 192, and the container 140 configures with three restrooms and a laundry room. It is possible to store up to 14 palletized shelters 50 in the container 140, but this arrangement is only possible when the container 140 is fully empty of all other contents that would make it a community. It is the configuration that would be used when a user wishes to maximize sleeping accommodations and not provide community amenities. The fencing 302 and benches 304 are not included in the containerized community, although they can be added locally by the community members.

As will be readily appreciated from the foregoing, the shelter and system of the present disclosure provide many novel features, including without limitation:

Design of a structural aluminum "cage" or framework that is lightweight, strong, and has key connection points, i.e., wall-to-floor connection, wall-to-wall connection, and roof-to-wall connections, with quick connect pins that eliminate the need for hand tools. In addition, the quick connect pin receivers minimize wear and tear while also controlling cost. The carefully shaped and placed structural elements within the subassemblies reduce the unassembled palletized package size and increase the structural integrity of the palletized shelter as a shipping unit for storage and transport. In addition, the design of the disassembled and palletized shelter maximizes the volume and enables standardization for use with a high cube shipping container The design and sizing of the community building blocks allow everything needed for the community model to be fit within the same shipping container for storage and shipment. The community system can be quickly and easily unpacked and deployed, and the shipping container can be converted to a useable shared bathroom and laundry facility.

The various implementations described above can be combined to provide further implementations. Aspects of the implementations can be modified, if necessary to employ concepts of the various patents, applications and publications to provide yet further implementations. For example, the aluminum material can be replaced with many other structural materials such as wood, but at the cost of increasing weight and reducing longevity through multiple assemblies and disassembles. Next to wood, aluminum is the most effective, light-weight, inexpensive structural material available. Similarly, the Plascore™ (honeycomb polypropylene) could be replaced with standard plywood, but again the weight would increase, the durability would decrease, the resistance to insects would be very poor.

In addition to the foregoing, the quick connectors could be replaced with nuts and bolts, although the assembly and disassembly would be slower and would require tools. Additional connection points could be provided, but it would be unnecessary "overkill" in terms of structural strength of the assembled unit. Likewise, the thin walled polycarbonate could be replaced with any of a variety of materials that are weather proof, but this would increase weight and lose the solar advantage.

The intermeshing of the structural frame members when palletizing the sub-assemblies could be eliminated but at the cost of increased thickness of the palletized disassembled components and the structural integrity would be reduced. One could choose to ship the shelters in any truck, but this would lose the use of the shipping container to convert to the shared bathroom and laundry facility.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A palletizable shelter, comprising:

a rigid base;

four rigid walls attachable to the base, the four rigid walls comprising a front wall, a rear wall, a first side wall, and a second side wall;

a roof attachable to the four walls, the roof comprising first and second roof panels; and a rigid framework comprising individual vertical frame members on each of the four walls and joist frame members on the roof, the vertical frame members on the first side wall are sized and shaped to be received within the vertical frame members on the second wall when the first and second side walls are in an abutting face-to-face and rotated in a 180 degree relationship, and the joist frame members on the first roof panel are received within the joist frame members on the second roof panel when the first and second roof panels are in an abutting and rotated in a 180 degree face-to-face relationship; and the shelter having a deployed configuration in which the base, the four walls, the roof are attached together via the rigid framework to form a shelter that defines an enclosed interior, the shelter having a palletized configuration in which the first and second walls, the front wall, the rear wall, and the first and second roof panels are layered on a rigid pallet and in which the first and second side walls are in the abutting face-to-face and rotated in a 180 degree relationship with the vertical frame members of the first side wall received within the vertical frame members of the second side wall, and further in which the first and second roof panels are in the abutting face-to-face and rotated in a 180 degree relationship with the joist frame members on the second roof panel received within the joist frame members on the first roof panel.

2. The shelter of claim 1 wherein the vertical frame members on the second wall and the joist frame members on the second roof panel have a U-shaped cross-sectional configuration with a channel that is sized and shaped to receive the vertical frame members of the first wall and the joist frame members of the first roof panel, respectively, in the U-shaped channel.

3. The shelter of claim 1 wherein the vertical frame members on each of the four walls have a first end structured to be coupled to the rigid base and a second end structured to be attached to the joist members on each of the first and second roof panels, the second end of the vertical frame members structured to be attached to the joist members on the first roof panel comprising a saddle sized and shaped to receive the joist members on the first roof panel, and the transverse members of the second roof panel comprising a saddle sized and shaped to receive the joist members of the second roof panel.

4. The shelter of claim 1 comprising at least two bunk bed brackets and two pivot pins for each one of the at least two bunk bed brackets, the at least two bunk bed brackets each having a yoke and an extension leg, the yoke structured to be pivotally attached to a respective vertical frame member by a first one of the two pivot pins extending through the yoke and the respective vertical frame member, and the yoke further structured to pivot into a deployed configuration in which the respective extension leg is substantially horizontal and the second one of the two pivot pins holds the yoke of the bracket to the respective vertical frame member in the deployed configuration, and the yoke further structured to rotate into a stored configuration in which the second pivot pin is removed from the yoke and the respective extension leg pivots to abut the respective vertical frame member.

5. The shelter of claim 1 comprising a corner flashing at each corner formed by the intersection of two of the four walls, the corner flashing having a first longitudinal leg extending from a second longitudinal leg at substantially a right angle, the first longitudinal leg having a first joist width, and the second longitudinal leg having a second joist width that is longer than the first joist width, the first longitudinal leg capable of being attached to a first one of the two walls so that the second longitudinal leg is spaced from the first one of the two walls to form a channel between the second longitudinal leg and the first one of the two walls that is sized and shaped to receive the second one of the at least two walls.

6. A system for storing and deploying transitional housing in a community setting, the system comprising:

a container having four walls, a bottom panel, and a top panel connected together to define an enclosed interior, the container structured to be shippable by rail, sea, or land; and at least one shelter that includes:

a rigid base;

four rigid walls attachable to the base, the four rigid walls comprising a front wall, a rear wall, a first side wall, and a second side wall;

a roof attachable to the four walls, the roof comprising first and second roof panels; and a rigid framework comprising individual vertical frame members on each of the four walls and joist frame members on the roof, the vertical frame members on the first side wall are sized and shaped to be received within the vertical frame members on the second wall when the first and second side walls are in an abutting face-to-face and rotated 180 degree relationship, and the joist frame members on the first roof panel are received within the joist frame members on the second roof panel when the first and second roof panels are in an abutting face-to-face and rotated 180 degree relationship; and the shelter having a deployed configuration in which the base, the four walls, the roof are attached together via the rigid framework to form the shelter that defines an enclosed interior, the shelter having a palletized configuration in which the first and second walls, the front wall, the rear wall, and the first and second roof panels are layered on a rigid pallet and in which the first and second side walls are in the abutting face-to-face and rotated 180 degree relationship with the vertical frame members of the first side wall received within the vertical frame members of the second side wall, and further in which the first and second roof panels are in the abutting face-to-face and rotated 180 degree relationship with the joist frame members on the second roof panel received within the joist frame members on the first roof panel.

7. The system of claim 6 wherein the vertical frame members on the second wall and the joist frame members on the second roof panel have a U-shaped cross-sectional configuration with a channel that is sized and shaped to receive the vertical frame members of the first wall and the first roof panel, respectively, in the U-shaped channel.

8. The system of claim 7 wherein the vertical frame members on each of the four walls have a first end structured to be coupled to the rigid base and a second end structured to be attached to the joist members on each of the first and second roof panels, the second end of the vertical frame members structured to be attached to the joist members on the first roof panel comprising a saddle sized and shaped to receive the joist members on the first roof panel, and the transverse members of the second roof panel comprising a saddle sized and shaped to receive the joist members of the second roof panel.

9. The shelter of claim 6 comprising at least two bunk bed brackets and two pivot pins for each one of the at least two bunk bed brackets, the at least two bunk bed brackets each having a yoke and an extension leg, the yoke structured to be pivotally attached to a respective vertical frame member by a first one of the two pivot pins extending through the yoke and the respective vertical frame member, and the yoke further structured to pivot into a deployed configuration in which the respective extension leg is substantially horizontal and the second one of the two pivot pins holds the yoke of the bracket to the respective vertical frame member in the deployed configuration, and the yoke further structured to rotate into a stored configuration in which the second pivot pin is removed from the yoke and the respective extension leg pivots to abut the respective vertical frame member.

10. The system of claim 6 comprising a corner flashing at each corner formed by the intersection of two of the four walls, the corner flashing having a first longitudinal leg extending from a second longitudinal leg at substantially a right angle, the first longitudinal leg having a first joist width, and the second longitudinal leg having a second joist width that is longer than the first joist width, the first longitudinal leg capable of being attached to a first one of the two walls so that the second longitudinal leg is spaced from the first one of the two walls to form a channel between the second longitudinal leg and the first one of the two walls that is sized and shaped to receive the second one of the at least two walls.

11. The system of claim 6 wherein the container is a high cube container sized and shaped to store at least 14 shelters in the palletized configuration and standing on end.

12. The system of claim 11 further comprising at least one portable toilet to be stored in the container.

13. The system of claim 12 further comprising at least one portable laundry with washer and dryer to be stored in the container.

14. The system of claim 13 further comprising removable walls in the container to enable accommodation of at least three portable toilets and at least one portable laundry in individual rooms in the container.

15. The system of claim 14 further comprising plumbing for the at least one portable laundry and at least three portable toilets and electrical wiring for the at least one portable laundry, the plumbing and electrical wiring structured to be stored in the container.

16. The system of claim 14 further comprising a yurt structured to be stored in the container and to be deployed as a community shelter.

17. The system of claim 16 further comprising one or more of a refrigerator, a range, and one or more cabinets to be stored in the container and deployed inside the deployed yurt.

* * * * *